US006811624B2

(12) United States Patent
Hoydick

(10) Patent No.: US 6,811,624 B2
(45) Date of Patent: Nov. 2, 2004

(54) METHOD FOR PRODUCTION OF DUAL PHASE SHEET STEEL

(75) Inventor: David Paul Hoydick, Pittsburgh, PA (US)

(73) Assignee: United States Steel Corporation, Pittsburgh, PA (US)

( * ) Notice: Subject to any disclaimer, the term of this patent is extended or adjusted under 35 U.S.C. 154(b) by 0 days.

(21) Appl. No.: 10/342,510

(22) Filed: Jan. 15, 2003

(65) Prior Publication Data

US 2004/0099349 A1 May 27, 2004

Related U.S. Application Data

(60) Provisional application No. 60/429,853, filed on Nov. 26, 2002.

(51) Int. Cl.[7] ..... C21D 9/46; C21D 6/00; C23C 2/06

(52) U.S. Cl. ..... 148/533; 148/501; 148/654; 148/614

(58) Field of Search ..... 148/533, 501, 148/654, 614

(56) References Cited

U.S. PATENT DOCUMENTS

| | | | | | |
|---|---|---|---|---|---|
| 4,544,419 | A | * | 10/1985 | Irie et al. | 148/505 |
| 4,759,807 | A | | 7/1988 | Sipppola | |
| 5,019,460 | A | | 5/1991 | Yasuda et al. | |
| 6,306,527 | B1 | | 10/2001 | Ikeda et al. | |
| 6,312,536 | B1 | * | 11/2001 | Omiya et al. | 148/533 |
| 6,316,127 | B1 | | 11/2001 | Ikeda et al. | |
| 6,440,584 | B1 | * | 8/2002 | Nagataki et al. | 428/659 |
| 6,517,955 | B1 | * | 2/2003 | Takada et al. | 428/659 |
| 6,586,117 | B2 | * | 7/2003 | Nomura et al. | 428/659 |

FOREIGN PATENT DOCUMENTS

| | | |
|---|---|---|
| JP | 4-26744 | 1/1992 |
| JP | 4-128320 | 4/1992 |
| JP | 4-128321 | 4/1992 |
| JP | 4-173945 | 6/1992 |
| JP | 5-331537 | 12/1993 |
| JP | 9-25537 | 1/1997 |
| JP | 9-263883 | 10/1997 |

OTHER PUBLICATIONS

Yoichi Tobiyama et al, "Development of 590 MPa Grade Galvanncaled Sheet Steels with Dual Phase Structure," Kawasaki Steel Technical Report, Kawasaki Steel, No. 42, p. 19–23, (May 14, 2000).

L.F.Porter and P.E.Repas, "The Evolution of HSLA Steels," Journal of Metals, p. 14–21, ( Apr. 14, 1982).

Jayanta S. Rege, Toru Inazumi et al, "Development of HDGI/HDGA Dual Phase Steel Family ( . . . ) at National Steel Corporation," 44th MWSP Conference Proceedings, Iron and Steel Society, p. 391–403, (v. XL, 2002).

A. Pichler, G. Ilribernig et al, "Aspects of ther Production of Dual Phase and Multiphase Steel Strips," MWSP Conference Proceedings, Iron and Steel Society, p. 37–59 (v. XXXVII, 1999).

* cited by examiner

*Primary Examiner*—Deborah Yee
(74) *Attorney, Agent, or Firm*—William L. Krayer

(57) ABSTRACT

Dual phase steel sheet is made using a time/temperature cycle including a soak at about 1340–1425F and a hold at 850–920F, where the steel has the composition in weight percent, carbon: 0.02–0.20; aluminum: 0.010–0.150; titanium: 0.01 max; silicon: 0.5 max; phosphorous: 0.060 max; sulfur: 0.030 max; manganese: 1.5–2.40; chromium: 0.03–1.50; molybdenum: 0.03–1.50; with the provisos that the amounts of manganese, chromium and molybdenum have the relationship: Mn+6Cr+10Mo)=at least 3.5%. The sheet is preferably in the form of a strip treated in a continuous galvanizing or galvannealing line, and the product is predominantly ferrite and martensite.

20 Claims, 6 Drawing Sheets

Laboratory Gleeble Investigations
C = 0.067, Mn = 1.81, Cr = 1.81, Mo = 0.19

UTS as a Function of Soak Temperature

Yield Ratio as a Function of Soak Temperature

METHOD FOR PRODUCTION OF DUAL PHASE SHEET STEEL

RELATED APPLICATION

This application incorporates in its entirety and claims the fill benefit of provisional application 60/429,853, of the same title, filed Nov. 26, 2002.

TECHNICAL FIELD

Dual phase galvanized steel strip is made utilizing a thermal profile involving a two-tiered isothermal soaking and holding sequence. The strip is at a temperature close to that of the molten metal when it enters the coating bath.

BACKGROUND OF THE INVENTION

Prior to the present invention, the galvanizing procedure whereby steel strip is both heat treated and metal coated has become well known and highly developed. Generally a cold rolled steel sheet is heated into the intercritical regime (between $Ac_1$ and $Ac_3$) to form some austenite and then cooled in a manner that some of the austenite is transformed into martensite, resulting in a microstructure of ferrite and martensite. Alloying elements such as Mn, Si, Cr and Mo are in the steel to aid in martensite formation. Various particular procedures have been followed to accomplish this, one of which is described in Omiya et al U.S. Pat. No. 6,312,536. In the Omiya et al patent, a cold rolled steel sheet is used as the base for hot dip galvanizing, the steel sheet having a particular composition which is said to be beneficial for the formation, under the conditions of the process, of a microstructure composed mainly of ferrite and martensite. The Omiya et al patent describes a galvanized dual phase product.

According to the Omiya et al patent, a dual phase galvanized steel sheet is made by soaking the cold rolled steel sheet at a temperature of 780° C. (1436° F.) or above, typically for 10 to 40 seconds, and then cooling it at a rate of at least 5° C. per second, more commonly 20–40° C. per second, before entering the galvanizing bath, which is at a temperature of 460° C. (860° F.). The steel, according to the Omiya et al patent, should have a composition as follows, in weight percent:

| | | | |
|---|---|---|---|
| Carbon: | 0.02–0.20 | Aluminum: | 0.010–0.150 |
| Titanium: | 0.01 max | Silicon: | 0.04 max |
| Phosphorous: | 0.060 max | Sulfur: | 0.030 max |
| Manganese: | 1.5–2.40 | Chromium: | 0.03–1.50 |
| Molybdenum: | 0.03–1.50 | | |

manganese, chromium and molybdenum should have the relationship:

3Mn+6Cr+Mo: 8.1% max, and

Mn+6Cr+10Mo: at least 3.5%

The Omiya et al patent is very clear that an initial heat-treating (soaking) step is conducted at a temperature of at least 780° C. (1436° F.). See column 5, lines 64–67; col 6, lines 2–4: "In order to obtain the desired microstructure and achieve stable formability, it is necessary to heat the steel sheet at 780° C. or above, which is higher than the $A_{C1}$ point by about 50° C. . . . Heating should be continued for more than 10 seconds so as to obtain the desired microstructure of ferrite+austenite." The process description then goes on to say the steel sheet is cooled to the plating bath temperature (usually 440–470° C., or 824–878° F.) at an average cooling rate greater than 1° C./second, and run through the plating bath. After plating, cooling at a rate of at least 5° C./second will achieve the desired microstructure of predominantly ferrite and martensite. Optionally, the plated sheet may be heated prior to cooling, in an alloying procedure (often called galvannealing) after metal coating but prior to the final cooling.

Omiya et al clearly do not appreciate that it is possible to achieve a dual phase product without the high temperatures of their soaking step, or that a particular holding step following a lower temperature soak can facilitate the desired microstructure formation.

SUMMARY OF THE INVENTION

I have found, contrary to the above quoted recitation in the Omiya et al patent, that not only is it not necessary to maintain the initial heat treatment temperature at 780° C. (1436° F.) or higher, but that the desired dual phase microstructure can be achieved by maintaining the temperature during an initial heat treatment (soaking) in the range from $A_{C1}$+45° F., but at least 1340° F. (727° C.), to $A_{C1}$+135° F., but no more than 1425° F. (775° C.). One does not need to maintain the temperature at 780° C. or higher, contrary to the Omiya et al patent, provided the rest of my procedure is followed. For convenience hereafter, my initial heat treatment will be referred to as the "soak." However, my process does not rely only on a lower temperature for the soak as compared to Omiya et al; rather, the soak temperature of ($A_{C1}$+45° F.) to 1425° F., usually 1340–1420° F., must be coupled with a subsequent substantially isothermal heat treatment, termed the holding step, in the range of 850–920° F. (454–493° C.). In the holding step, the sheet is maintained at 850–920° F. (454–493° C.), sometimes herein expressed as 885° F.±35° F., for a period of 20 to 100 seconds, before cooling to room (ambient) temperature. Cooling to ambient temperature should be conducted at a rate of at least 5° C. per second. It is important to note, once again, that the Omiya et al patent says nothing about a holding step at any temperature or for any time in their thermal process. Furthermore, my work has shown that if a steel as defined in the Omiya et al patent is soaked within Omiya's defined, higher, soaking range (for example 1475° F.) and further processed through a thermal cycle including a holding step as described herein (850–920° F.), the resultant steel will not achieve the desired predominantly ferrite-martensite microstructure but will contain a significant amount of bainite and/or pearlite.

I express the lower temperature limit of the soak step as "$Ac_1$+45° F., but at least 1340° F. (727° C.)", because virtually all steels of Composition A will have an $A_{C1}$ of at least 1295° F.

The steel sheet should have a composition similar to that of the Ochiya et al patent:

| | | | |
|---|---|---|---|
| Carbon: | 0.02–0.20 | Aluminum: | 0.010–0.150 |
| Titanium: | 0.01 max | Silicon: | 0.04 max |
| Phosphorous: | 0.060 max | Sulfur: | 0.030 max |
| Manganese: | 1.5–2.40 | Chromium: | 0.03–1.50 |
| Molybdenum: | 0.03–1.50 | | |

manganese, chromium and molybdenum should have the relationship:

Mn+6Cr+10Mo: at least 3.5%

For my purposes, the silicon content may be as much as 0.5%, and, preferably, carbon content is 0.03–0.12% although the Omiya et al carbon range may also be used. This composition, as modified, may be referred to hereafter as Composition A.

Thus my invention is a method of making a dual phase steel sheet comprising soaking a steel sheet at a temperature of in the range from $A_{C1}$+45° F., but at least 1340° F. (727° C.), to $A_{C1}$+135° F., but no more than 1425° F. (775° C.), for a period of 20 to 90 seconds, cooling the sheet at a rate no lower than 1° C./second to a temperature of 454–493° C., and holding the sheet at temperatures in the range of 850–920F (454–493° C.) for a period of 20 to 100 seconds. The holding step may be prior to the hot dip or may begin with the hot dip, as the galvanizing pot will be at a temperature also in the range 454–493° C. (850–920° F.). Immediately after the holding step, whether or not the sheet is galvanized, the sheet can be cooled to ambient temperature at a rate of at least 5° C./second. Alternatively, after the sheet is coated, the sheet may be galvannealed in the conventional manner—that is, the sheet is heated for about 5–20 seconds to a temperature usually no higher than about 960° F. and then cooled at a rate of at least 5° C./second. My galvannealed and galvanized thermal cycles are shown for comparison in FIG. 6.

The actual hot dip step is conducted more or less conventionally—that is, the steel is contacted with the molten galvanizing metal for about 5 seconds; while a shorter time may suffice in some cases, a considerably longer time may be used but may not be expected to result in an improved result. The steel strip is generally about 0.7 mm thick to about 2.5 mm thick, and the coating will typically be about 10 $\mu$m. After the holding and coating step, the coated steel may be either cooled to ambient temperature as described elsewhere herein or conventionally galvannealed, as described above. When the above protocol is followed, a product having a microstructure comprising mainly ferrite and martensite will be obtained.

Commercially, it is common to perform hot dip galvainizing substantially contiunously by using coils of steel strip, typically from 1000 to 6000 feet long. My invention permits more convenient control over the process not only because the soak step takes place at a lower temperature, but also because the strip may be more readily kept at the same temperature as the hot dip vessel entering and leaving it, with little concern about significant heat transfer occurring between steel strip and zinc pot that could heat up the molten zinc and limit production.

As applied specifically to a continuous steel strip galvanizing line, which includes a strip feeding facility and a galvanizing bath, my invention comprises feeding a cold rolled coil of steel strip of Composition A to a heating zone in the galvanizing line, passing the strip through a heating zone continuously to heat the strip to within the range of $A_{C1}$+45° F., but at least 1340° F. (727° C.), to $A_{C1}$+135° F., but no more than 1425° F. (775° C.), passing the strip through a soaking zone to maintain the strip within the range of $A_{C1}$+45° F., but at least 1340° F. (727° C.), to $A_{C1}$+135° F., but no more than 1425° F. (775° C.), for a period of 20 to 90 seconds, passing the strip through a cooling zone to cool the strip at a rate greater than 1° C./second, discontinuing cooling the strip when the temperature of the strip has been reduced to a temperature in the range 885° F.±35° F., but also ±30 degrees F. of the temperature of the galvanizing bath, (preferably within 20 degrees F.±the temperature of the bath, and more preferably within 10 degrees F.±the temperature of the bath), holding the strip within 30 degrees F. of the temperature of the galvanizing bath (again preferably within 20 degrees F.±the temperature of the bath, and more preferably within 10 degrees F.±the temperature of the bath) for a period of 20 to 100 seconds, passing the strip through the galvanizing bath, optionally galvannealing the coated strip, and cooling the strip to ambient temperature. The galvanizing bath is typically at about 870° F. (850–920° F.), and may be located at the beginning of the holding zone, or near the end of the hold zone, or anywhere else in the holding zone, or immediately after it. Residence time in the bath is normally 3–6 seconds, but may vary somewhat, particularly on the high side, perhaps up to 10 seconds. As indicated above, after the steel is dipped into and removed from the zinc bath, the sheet can be heated in the conventional way prior to cooling to room temperature to form a galvanneal coating, if desired.

Figure 4:
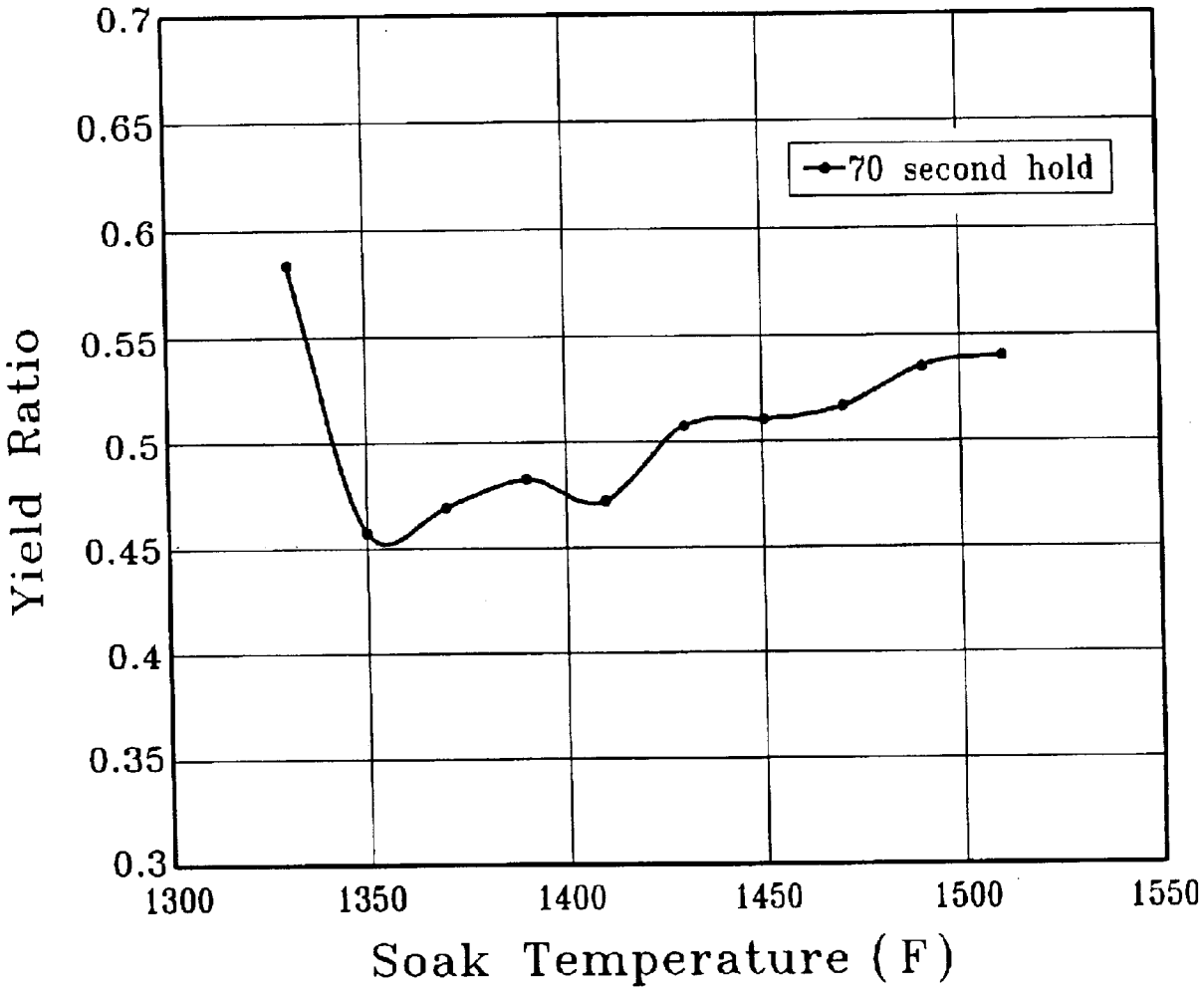

FIG. 4, yield ratios are shown for a steel of a composition different from that of Example 1.

Figure 5:
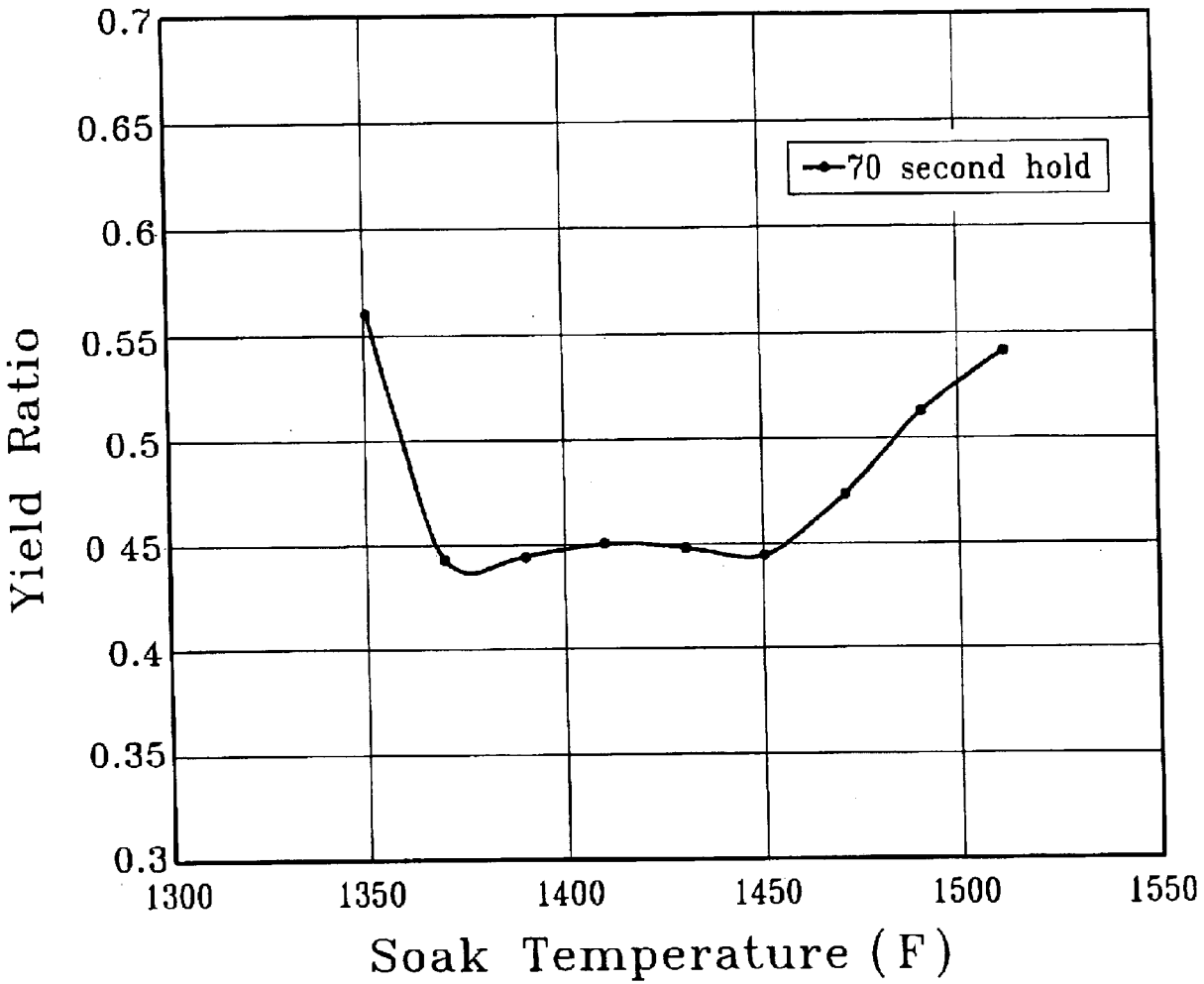

FIG. 5 shows yield ratios for a third steel composition.

Figure 6:
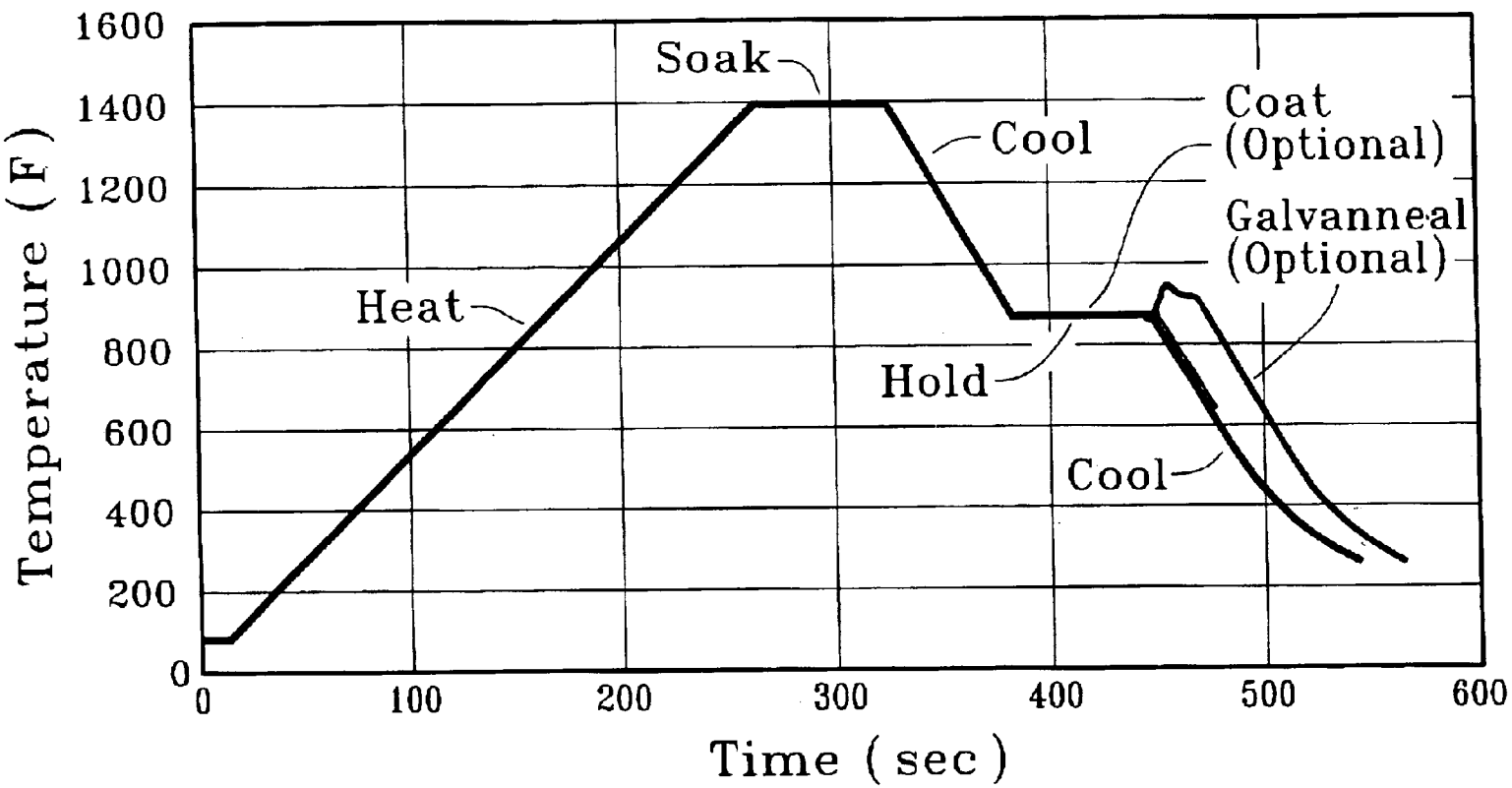

FIG. 6 shows the preferred thermal including galvanizing and galvannealing steps.

EXAMPLE 1

Figure 1:
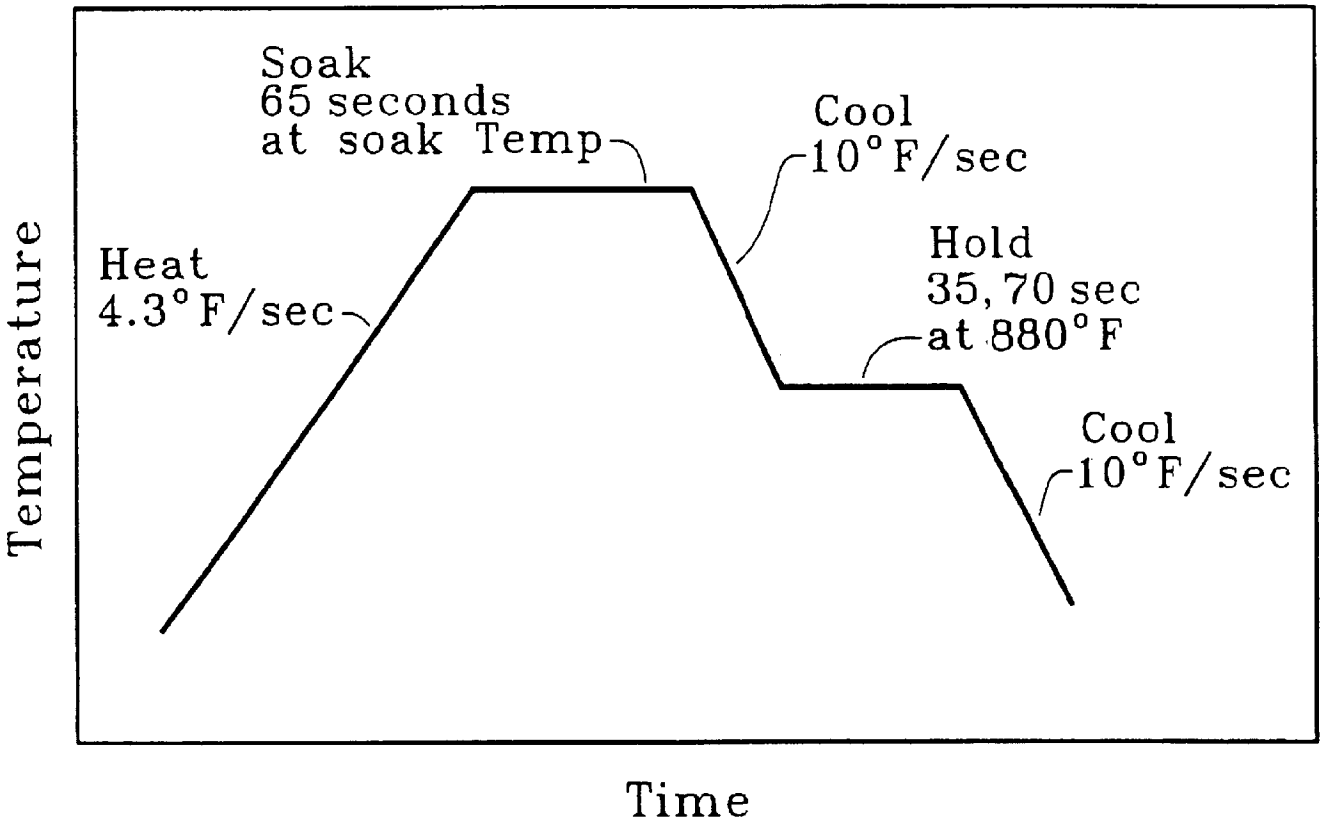
FIG. 1 is a time/temperature line showing the general thermal cycle of the invention, followed in example 1.
Figure 2:
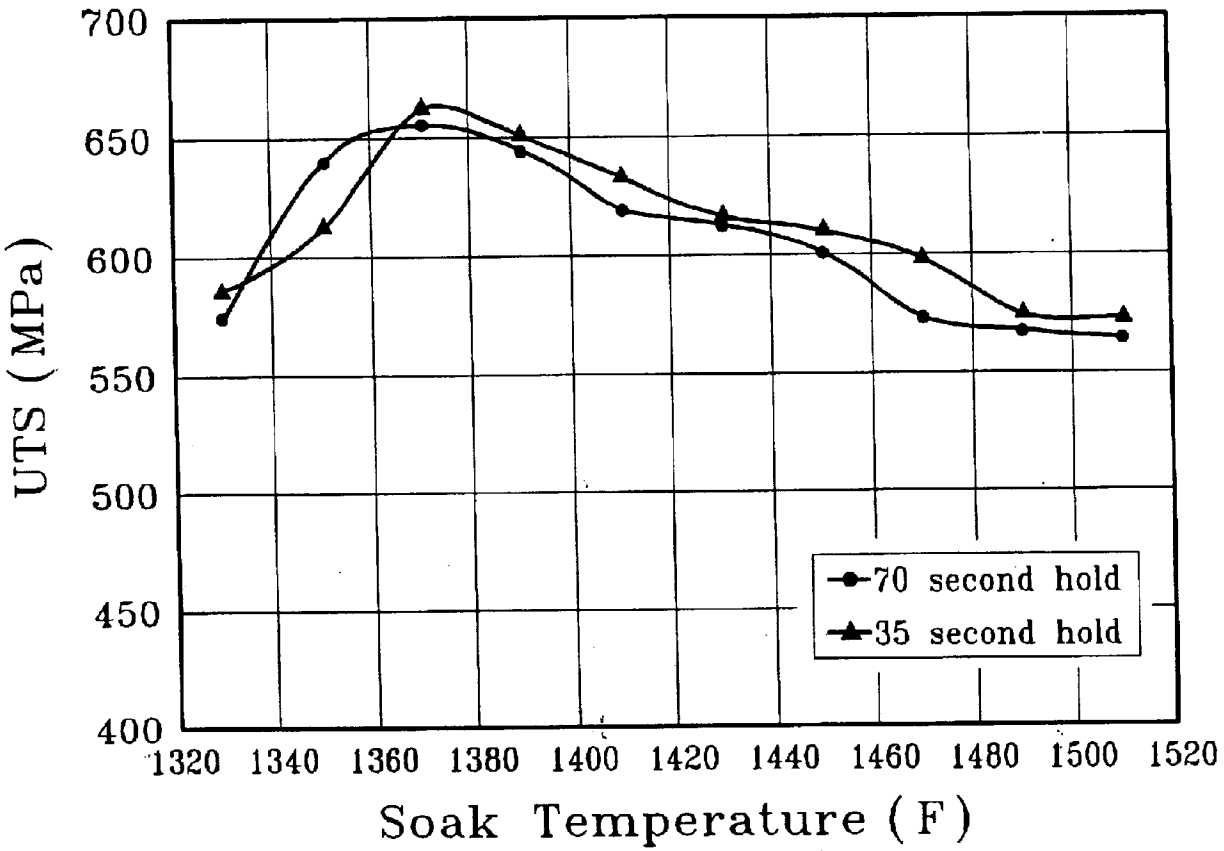
FIG. 2 shows the ultimate tensile strength of the product as a function of soak temperature and hold time.

Samples of steel sheet were processed, with various "soak" temperatures according to the general thermal cycle depicted in FIG. 1—one set of samples followed the illustrated curve with a 35 second "hold" at 880° F. and the other set of samples were held at 880° F. for 70 seconds. The samples were cold rolled steel of composition A as described above—in particular, the carbon was 0.67, Mn was 1.81, Cr was 0.18 and Mo was 0.19, all in weight percent. The other elemental ingredients were typical of low carbon, Al killed steel. Soak temperatures were varied in increments of 20° F. within the range of 1330 to 1510° F. After cooling, the mechanical properties and microstructures of the modified samples were determined. Ultimate tensile strength ("UTS") of the resulting products as a function of soak temperature and hold time is shown in FIG. 2. For this particular material, a minimum UTS of 600 MPa was the target and was achieved over a range of soak temperatures from about 1350° F. to 1450° F. for both hold times.

Figure 3:
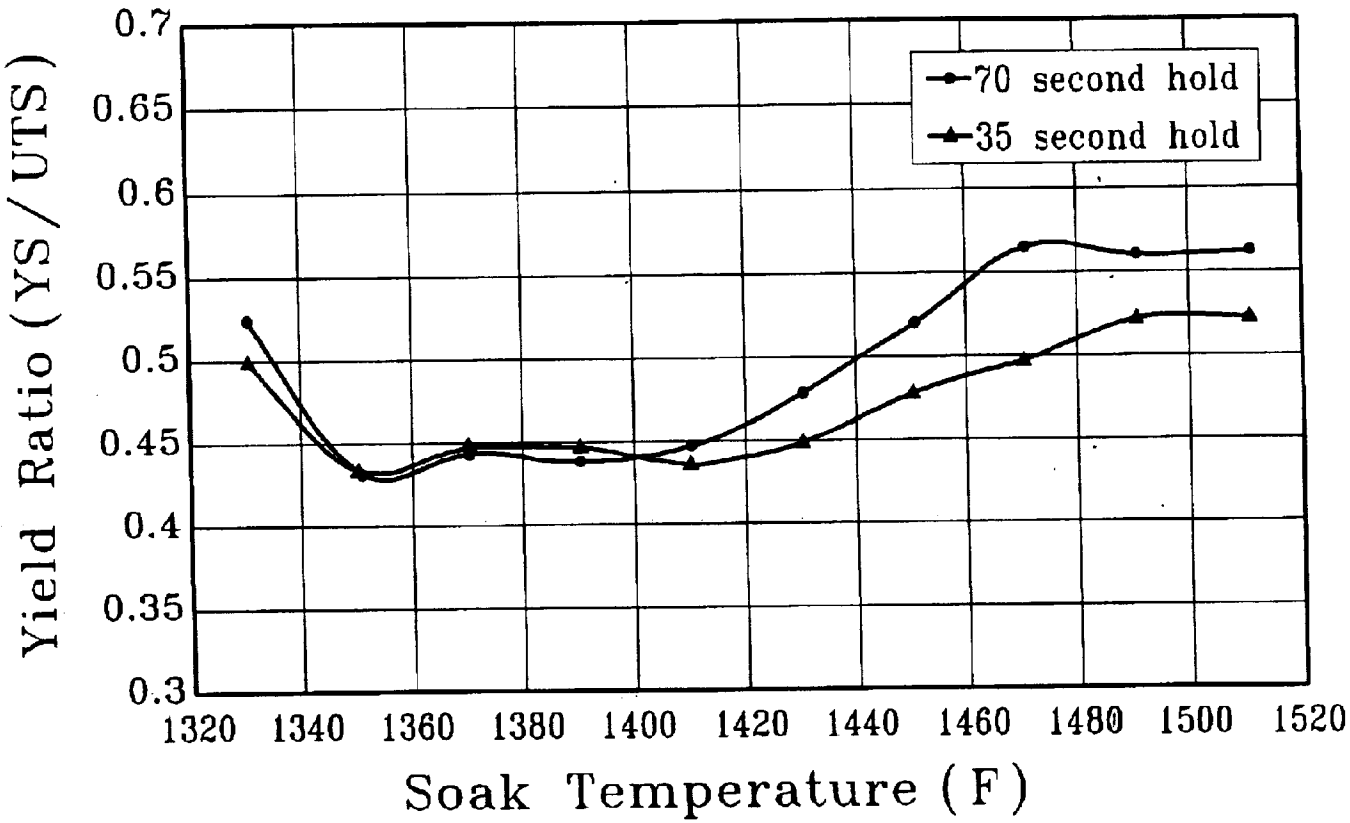
FIG. 3 shows the yield ratio as a function of soak temperature for two different holding times.

A goal of Example 1 was to achieve a predominantly ferrite-martensite microstructure. The yield ratio, i.e. the ratio of yield strength to ultimate tensile strength, is an indication whether or not a dual phase ferrite-martensite microstructure is present. When processed as in Example 1, a ferrite-martensite microstructure is indicated when the yield ratio is 0.5 or less. If the yield ratio is greater than about 0.5, a significant volume fraction of other deleterious constituents such as bainite, pearlite, and/or $Fe_3C$ may be expected in the microstructure. FIG. 3 shows the yield ratio as a function of soak temperature for both the 35 and 70 second holding zones for the samples. Note that a very low yield ratio of about 0.45 is achieved over a range of temperatures for both curves from about 1350–1430° F., indicating optimum dual phase properties over this soak temperature range. Metallographic analyses of the samples performed on steels soaked within this 1350–1430° F. soak range confirmed a ferrite-martensite microstructure. Quantitative metallography using point counting techniques revealed martensite contents of 14.5 and 13.5% respectively, for the steel soaked at 1390 and held at 880° F. for 70 and 35 seconds, respectively, with no other constituents observed in the microstructure. (The images were constructed using the Lepera etching technique for which ferrite appears light gray, martensite white, and such as pearlite and bainite appearing black). For soak temperatures below about 1350° F., as expected, iron carbide ($Fe_3C$) remains in the microstructure due to insufficient carbide dissolution which results in limited martensite formation during cooling.

Unexpected, however, is the appearance of bainite in the microstructure when soak temperatures get above about 1430° F. For example, metallographic analyses reveal a bainite content of 8.5% for the steel soaked at 1510° F. and held at 880° F. for 70 seconds. These results contrast strongly with Omiya. According to Omiya, it is in this soak temperature range, i.e. necessarily above 1436° F., that a ferrite-martensite microstructure should be expected. My work indicates that a significant amount of bainite is present in the microstructure when the annealing soak temperature is in the Omiya recommended range and a hold zone in the vicinity of 880° F. is present in the thermal process. For the particular steel used in this example, the necessary annealing range for ferrite-martensite microstructures is from about 1350 to 1430° F. Table 1 summarizes the relationships between the thermal process, yield ratio and microstructural constituents for this example at the different soak temperature regimes.

TABLE 1

| Soak Temp ° F. | Hold Temp ° F. | Hold Time (sec) | Yield Ratio | Percent Martensite | Percent Bainite |
|---|---|---|---|---|---|
| 1330 | 880 | 35 | 0.50 | <3 | <1 |
| 1330 | 880 | 70 | 0.52 | <3 | <1 |
| 1390 | 880 | 35 | 0.45 | 14.5 | <1 |
| 1390 | 880 | 70 | 0.44 | 13.5 | <1 |
| 1510 | 880 | 35 | 0.52 | 4.5 | 11 |
| 1510 | 880 | 70 | 0.56 | 4.5 | 8.5 |

EXAMPLE 2

A different cold rolled sheet steel of Composition A was subjected to the same set of thermal cycles a described in Example 1 and shown in FIG. 1. This steel also lay within the stated composition range, in this case specifically containing the following, in weight percent: 0.12%C, 1.96%Mn, 0.24%Cr, and 0.18%Mo, and the balance of the composition typical for a low carbon Al-killed steel. Once again, the mechanical properties of the material were measured. The effect of soak temperature on yield ratio for this steel for the 70 second holding sequence at 880° F. is shown in FIG. 4. This curve exhibits a shape similar to the curves in FIG. 3, with metallographic analyses revealing identical metallogical phenomena occurring at the different soak temperature regimes as in the previous example. Also as demonstrated in the previous example, the annealing soak temperature range necessary for a predominantly ferrite-martensite microstructure to be obtained is from about 1350 to 1425° F. when a hold step is conducted at about 880° F.

EXAMPLE 3

As in the previous two examples, a third cold-rolled steel of Composition A was processed according to the set of thermal cycles shown in FIG. 1. This steel contained, in weight percent, 0.076C, 1.89 Mn, 0.10 Cr, 0.094 Mo, and 0.34 Si, the balance of which is typical for a low carbon steel. After annealing as in the other examples, the mechanical properties and resultant microstructures were again determined. FIG. 5 shows the yield ratio of this material as a function of soak temperature for the holding time of 70 seconds. Once again, a curve having a shape similar to the previous examples is observed, with a precise annealing range over which the dual phase ferrite-martensite microstructure is achieved. However, note that the curve appears to be shifted to the right about 30° F. as compared to the previous examples. This is due to the fact that the Ac1 temperature is higher for this steel as compared to the steels in the previous two examples due to the higher silicon. Table 2 shows the necessary soak temperature range for ferrite-martensite formation for each of the steels along with their respective Ac1 temperature according to Andrews. The preferred annealing range appears to be a function of the Ac1 temperature as shown. Generically, based on this information, the soak temperature range necessary for dual phase production depends on the specific steel composition—that is, it should lie within the range from $A_{C1}$+45° F., but at least 1340° F. (727° C.), to $A_{C1}$+135° F., but no more than 1425° F. (775° C.) when a holding step in the vicinity of 880° (885° F.±35° F.) is present in the thermal cycle.

TABLE 2

| C (wt %) | Mn (wt %) | Cr (wt %) | Mo (wt %) | Si (wt %) | $A_{c1}$ (° F.) | AR for FM (° F)* | Necessary AR for DP Steel re $A_{c1}$** |
|---|---|---|---|---|---|---|---|
| .067 | 1.81 | .18 | .19 | .006 | 1304 | 1350–1430 | $A_{c1}$+46 to $A_{c1}$+126 |
| .12 | 1.96 | .24 | .18 | .006 | 1303 | 1350–1420 | $A_{c1}$+47 to $A_{c1}$+117 |
| .076 | 1.89 | .1 | .094 | .34 | 1318 | 1380–1450 | $A_{c1}$+62 to $A_{c1}$+132 |

*Annealing Range for Ferrite-Martensite (degrees Fahrenheit)
**Necessary Annealing Range for Dual Phase Steel with respect to $A_{c1}$.

EXAMPLE 4

Table 3 shows the resultant mechanical properties of two additional steels having carbon contents lower than shown previously. They were processed as described in FIG. 1 utilizing the individual soak temperatures of 1365, 1400, and 1475° F., respectively and a hold time of 70 seconds at 880° F. Also shown within the table are the expected necessary soak temperature ranges for dual phase steel production for each steel as calculated from $A_{c1}$ as described in Example 3. Note that for the 1365 and 1400° F. soak temperatures, which reside within the desired soak temperature range for both respective steels, low yield ratios characteristic of ferrite-martensite microstructures are observed. Furthermore, for the steels soaked at 1475° F., which is outside the range present invention, the yield ratio is significantly higher due to the presence of bainite in the microstructure.

TABLE 3

| C (wt %) | Mn (wt %) | Mo (wt %) | Cr (wt %) | $A_{c1}$ | $A_{c1}$+45 to $A_{c1}$+135 (° F.) | Soak Temp | Yield Strgth (MPa) | UTS (MPa) | Yield Ratio |
|---|---|---|---|---|---|---|---|---|---|
| .032 | 1.81 | .2 | .2 | 1305 | 1350 to 1435 | 1365 | 223 | 473 | 0.47 |
| .032 | 1.81 | .2 | .2 | 1305 | 1350 to 1435 | 1400 | 226 | 474 | 0.48 |
| .032 | 1.81 | .2 | .2 | 1305 | 1350 to 1435 | 1475 | 261 | 462 | 0.56 |
| .044 | 1.86 | .2 | .2 | 1304 | 1349 to 1434 | 1365 | 244 | 559 | 0.44 |
| .044 | 1.86 | .2 | .2 | 1304 | 1349 to 1434 | 1400 | 239 | 548 | 0.44 |
| .044 | 1.86 | .2 | .2 | 1304 | 1349 to 1434 | 1475 | 265 | 519 | 0.51 |

EXAMPLE 5

The previous examples were based on laboratory work, but mill trials have also taken place that have verified the aforementioned thermal processing scheme for the production of both hot-dipped galvanized and galvannealed dual phase steel product. Table 4 shows the results of mill trials for galvannealed steel. Note that the steels shown in the table have virtually the same composition and thus similar $A_{c1}$ temperatures. From the $A_{c1}$ temperature, the expected soak temperature range for dual phase formation is calculated to be about 1350 to 1440° F. Furthermore, in terms of processing, hold temperatures and times are fairly consistent among the steels and the annealing (soak) temperature is the main processing variable difference between the materials. The mechanical properties are also shown in the table along with corresponding yield ratios. Note that steels 1 through 4 were soaked within the soaking range of the invention and exhibited the expected yield ratio of less than 0.5. Metallographic examination revealed the presence of ferrite martensite microstructures for steels 1 through 4 with martensite contents of about 15%. Steel 5 was processed outside of the preferred soaking range and exhibited a relatively high yield ratio of about 0.61. Metallographic analysis showed a bainite content of 11% in this material. Similar results have been shown for galvanize as well as galvanneal processing.

TABLE 4

| Steel | 1 | 2 | 3 | 4 | 5 |
|---|---|---|---|---|---|
| Carbon | .067 | .067 | .067 | .067 | 0.77 |
| Mn | 1.81 | 1.81 | 1.81 | 1.81 | 1.71 |
| Cr | .18 | .18 | .18 | .18 | .19 |
| Mo | .19 | .19 | .19 | .19 | .17 |
| $A_{c1}$ | 1304 | 1304 | 1304 | 1304 | 1306 |
| $A_{c1}$ + 45 to $A_{c1}$ + 135 (° F.) | 1349–1439 | 1349–1439 | 1349–1439 | 1349–1439 | 1351–1441 |
| Soak Temp | 1370 | 1383 | 1401 | 1421 | 1475 |
| Hold Temp | 878 | 881 | 885 | 888 | 890 |
| Hold Time | 70 | 70 | 70 | 70 | 64 |
| Yield Strength | 292 | 299 | 294 | 296 | 327 |
| UTS | 606 | 610 | 614 | 618 | 538 |
| Yield Ratio | .48 | .49 | .48 | .48 | .61 |

What is claimed is:

1. Method of making an incipient dual phase steel sheet, wherein said steel sheet has the composition, in weight percent, carbon: 0.02–0.20; aluminum: 0.010–0.150; titanium: 0.01 max; silicon: 0.5 max; phosphorous: 0.060 max; sulfur: 0.030 max; manganese: 1.5–2.40; chromium: 0.03–1.50; molybdenum: 0.03–1.50; with the provisos that the amounts of manganese, chromium and molybdenum have the relationship: (Mn+6Cr+10Mo)=at least 3.5%, comprising soaking said steel sheet for 20 to 90 seconds at a temperature within the range of $A_{cl}$+45° F., but at least 1340° F. (727° C.), to $A_{C1}$+135° F., but no more than 1425° F. (775° C.), cooling said steel sheet at a rate of at least 1° C. per second to a temperature in the range 850–920° F., and holding said steel sheet in the range 850–920° F. for 20 to 100 seconds.

2. Method of claim 1 wherein said steel sheet is a steel strip and said method is conducted continuously on a steel strip of at least 1000 feet.

3. Method of claim 1 including coating said steel sheet in a vessel of molten galvanizing metal at a temperature in the range 850–920° F. before, during, or immediately after said holding.

4. Method of claim 3 wherein the temperature of said steel sheet during said coating is maintained within ±20° F. of the molten metal temperature to minimize heat transfer between said steel strip and said molten metal.

5. Method of claim 1 followed by cooling said steel sheet to ambient temperature at a rate of at least 5° C. per second, and wherein said dual phase is manifested thereafter in a microstructure predominantly of ferrite and martensite.

6. Method of claim 1 including galvannealing said steel sheet and cooling the steel sheet coated thereby at a rate of at least 5° C. per second, and wherein said dual phase is manifested thereafter in a microstructure predominantly of ferrite and martensite.

7. Method of claim 1 wherein the carbon content of said steel is 0.03–0.12%.

8. Method of substantially continuously galvanizing steel strip in a galvanizing line including a galvanizing bath, comprising feeding a coil of steel strip having the composition carbon: 0.02–0.20; aluminum: 0.010–0.150; titanium: 0.01 max; silicon: 0.5 max; phosphorous: 0.060 max; sulfur: 0.030 max; manganese: 1.5–2.40; chromium: 0.03–1.50; molybdenum: 0.03–1.50; with the provisos that the amounts of manganese, chromium and molybdenum have the relationship (Mn+6Cr+10Mo) at least 3.5%, to a heating zone in said galvanizing line, passing said strip through a heating zone continuously to heat said strip to 1340–1425° F., passing said strip through a soaking zone to maintain said strip within the range of 1340–1420° F. for a period of 20 to 90 seconds, passing said strip through a cooling zone to cool said strip at a rate greater than 1° C. per second, discontinuing cooling said strip when the temperature of said strip has been reduced to a temperature ±30 degrees F. of the temperature of said galvanizing bath, holding said strip at a temperature between 850–920° F. and within 30 degrees F. of the temperature of said galvanizing bath for a period of 20 to 100 seconds, passing said strip through said galvanizing bath, and cooling said strip to ambient temperature.

9. Method of claim 8 wherein the residence time of said strip in said galvanizing bath is 3–6 seconds.

10. Method of claim 8 wherein said cooling in said cooling zone is conducted at 5 to 40 degrees F. per second.

11. Method of claim 8 wherein said strip enters said galvanizing bath at a temperature within 10 degrees F. of the temperature of said galvanizing bath.

12. Method of claim 8 wherein said strip is passed into said galvanizing bath immediately on discontinuing said cooling.

13. Method of claim 8 wherein said strip is passed into said galvanizing bath near the end of said period of 20 to 100 seconds.

14. Method of claim 8 whereby the galvanized steel strip so made has a predominantly ferrite-martensite microstructure containing less than 5% other morphological constituents.

15. Method of claim 8 wherein the carbon content of said steel strip is 0.03–0.12 weight percent.

16. Method of claim 8 wherein said steel strip is galvannealed prior to cooling to ambient temperature.

17. Method of making a galvanized steel strip having a predominantly martensite and ferrite microstructure, wherein said steel has the ingredients, in weight percent, carbon: 0.02–0.20; aluminum: 0.010–0.150; titanium: 0.01 max; silicon: 0.5 max; phosphorous: 0.060 max; sulfur: 0.030 max; manganese: 1.5–2.40; chromium: 0.03–1.50; molybdenum: 0.03–1.50, comprising soaking said steel strip at $A_{C1}$+45° F., but at least 1340° F., to $A_{C1}$+135° F. but no more than 1425° F., for at least 20 seconds, cooling said strip at a rate of at least 1° C. per second, passing said strip through a galvanizing vessel for a residence time therein of 2–9 seconds to coat said strip at any time while holding said strip at 885° F.±35° F. for 20 to 100 seconds, and cooling the strip so coated to ambient temperature.

18. Method of claim 17 including galvannealing said strip prior to cooling to ambient temperature.

19. Method of claim 17 wherein said strip is within 20° F. of the temperature of the galvanizing vessel during said residence time therein.

20. Method of claim 17 wherein said strip is within 10° F. of the temperature of the galvanizing vessel during said residence time therein.

* * * * *